US006334415B1

(12) United States Patent
Fukuhara et al.

(10) Patent No.: US 6,334,415 B1
(45) Date of Patent: Jan. 1, 2002

(54) VALVE TIMING VARIATION DEVICE

(75) Inventors: Katuyuki Fukuhara, Hyogo; Makoto Yamauchi; Mutsuo Sekiya, both of Tokyo, all of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/666,328

(22) Filed: Sep. 21, 2000

Related U.S. Application Data

(62) Division of application No. 09/219,812, filed on Dec. 23, 1998.

(30) Foreign Application Priority Data

Jul. 22, 1998 (JP) ..... 10-206722

(51) Int. Cl.[7] ..... F01L 1/344

(52) U.S. Cl. ..... 123/90.17; 123/90.37; 74/568 R; 464/2

(58) Field of Search ..... 123/90.15, 90.17, 123/90.31, 90.37; 74/568 R; 464/1, 2, 160

(56) References Cited

U.S. PATENT DOCUMENTS

| | | | | | |
|---|---|---|---|---|---|
| 3,990,819 | A | | 11/1976 | Ritchie | 418/91 |
| 5,305,721 | A | | 4/1994 | Burtis | 123/205 |
| 5,666,914 | A | | 9/1997 | Ushida et al. | 123/90.17 |
| 5,727,508 | A | * | 3/1998 | Goppelt | 123/90.17 |
| 5,738,056 | A | | 4/1998 | Mikame et al. | 123/90.17 |
| 5,816,204 | A | * | 10/1998 | Moriya et al. | 123/90.17 |
| 5,865,151 | A | | 2/1999 | Fukaya et al. | 123/90.17 |
| 5,957,098 | A | | 9/1999 | Fukuhara et al. | 123/90.17 |
| 6,032,626 | A | * | 3/2000 | Haag | 123/90.17 |

FOREIGN PATENT DOCUMENTS

| | | |
|---|---|---|
| EP | 1454747 | 11/1976 |
| JP | 9-324611 | 12/1997 |

* cited by examiner

*Primary Examiner*—Weilun Lo
(74) *Attorney, Agent, or Firm*—Sughrue Mion, PLLC

(57) ABSTRACT

Since the conventionally the chip seal 14, 16 and the metallic blade spring 15, 17 have been formed separately, assembly efficiency has been poor (for example when the chip seal 14, 16 is inserted, the metallic blade spring 15, 17 detaches and falls out) which lowers productivity. As a result, the cross sectional shape of the chip seal 21 which pushes against the rotor 13 is made in the shape of a letter L.

4 Claims, 5 Drawing Sheets

VALVE TIMING VARIATION DEVICE

This is a divisional of Application Ser. No. 09/219,812 filed Dec. 23, 1998, the disclosure of which is incorporated herein by reference.

FIELD OF THE INVENTION

The present invention relates to a valve timing variation device which controls the timing of the opening and closing of a valve.

DESCRIPTION OF THE PRIOR ART

FIGS. 7 and 8 are cross sections showing a conventional valve timing variation device. FIGS. 9A and 9B are cross sections showing the structure of a chip seal of a valve timing variation device. In the figures, reference numeral 1 denotes an electronic control unit (hereafter ECU) which controls the oil control valve 2 and the like. 2 is an oil control valve (hereafter OCV) which supplies working oil to the actuator 3 under the control of the ECU 1. 3 is an actuator which controls the displacement angle of the camshaft 6 with respect to the timing pulley 8 when the working oil is supplied from the OCV 2 and which continuously regulates the timing of the opening and closing of the air intake valve. 4 and 5 are oil passages through which the working oil which is supplied from the OCV 2 flows. 6 is a camshaft which drives the opening and closing of the intake valve of the engine. 7 is a cam of the camshaft 6. 8 is a timing pulley arranged on one end of the camshaft 6. 9 is a bearing of the camshaft 6.

10 is a housing mounted so as to be freely rotatable with respect to the camshaft 6. 11 is a case fixed to the housing 10. 12 is a bolt which fixes the case 11 to the housing 10. 13 is a rotor which is fixed to the camshaft 6 and which rotates relative to the case 11. 14 and 16 are chip seals which prevent the movement of oil between the oil chambers 18 which are separated by the case 11 and the rotor 13. 15 is a metallic blade spring which is disposed between case 11 and the chip seal 14 and which pressures the chip seal 14 against the rotor 13. 17 is a metallic blade spring which is disposed between rotor 13 and the chip seal 14 and which pressures the chip seal 16 against the case 11. 18 are oil chambers which are separated by the case 11 and the rotor 13.

Next the operation of the invention will be explained.

Although the valve timing variation device controls the rotational direction of the housing 10 and the timing of the opening and closing of the air intake and exhaust valves of the engine by controlling of the amount of oil flowing into each oil chamber 18, in order to prevent the movement of oil between the oil chambers 18, a chip seal 14 is pushed against the rotor 13 and a chip seal 16 is pushed against the case 11.

In other words, as shown in FIG. 9A, the chip seal 14 is pushed against the rotor 13 by the blade spring 15 disposed between the case 11 and the chip seal 14. Furthermore the chip seal 16 as shown in FIG. 9B, is pushed against the case 11 by the blade spring 17 which is disposed between the rotor 13 and the chip seal 16.

The attachment of the chip seals 14 and 16 is performed by insertion between the case 11 and the rotor 13 in the direction from the left side of FIGS. 9A and 9B (the front of FIG. 8) to the right side (the back of FIG. 8) so that the chip seals 14, 16 and the metallic blade springs 15, 17 do not become disassembled.

Apart from the conventional example given above, a similar arrangement is disclosed in JP-A-9-324611.

Since conventional valve timing variation devices are constructed as above, chip seals 14, 16 are pushed onto the rotor 13 or the case 11 using blade springs 15, 17. However since the chip seals 14, 16 and the blade springs 15, 17 have different structures, the problem has arisen that assembly efficiency is extremely poor (for example when the chip seals 14, 16 are inserted the blade spring 15, 17 becomes detached and fall out) which reduces productivity.

SUMMARY OF THE INVENTION

The present invention is proposed to solve the above problems and has the objective of obtaining a valve timing variation device which can increase assemblying efficiency when the chip seals are assembled.

According to the first embodiment of the invention, the chip seal of the valve timing variation device has the shape of a letter "L" when taken in cross section.

According to the first embodiment of the invention, since the cross sectional shape of the chip seal has the shape of a letter "L", the efficiency of assembling the chip seal can be increased.

According to the second embodiment of the present invention, the valve timing variation device is adapted to integrally form a chip seal and a flexible member.

According to the second embodiment, since the chip seal and the flexible member are formed integrally, assemblying efficiency of the chip seal is conspicuously increased.

According to the third embodiment of the present invention, the valve timing variation device is adapted to insert a blade spring into the chip seal.

According to the third embodiment, since the blade spring is formed to be inserted into the chip seal, it is possible to avoid the deficiency of the chip seal and the blade spring disassembling during assembly.

According to the fourth embodiment of the present invention, the valve timing variation device is adapted so that both legs of the chip seal are bent to form a flexible member.

According to the fourth embodiment, since both legs of the chip seal are bent to form a flexible member, it is possible to reduce manufacturing costs and at the same time conspicuously improve assembling efficiency of the chip seal.

According to the fifth embodiment of the present invention, the valve timing variation device is adapted to fix the flexible member which has lower hardness than the chip seal to the chip seal.

According to the fifth embodiment, by fixing the flexible member which has lower hardness than the chip seal to the chip seal, it is possible to lower manufacturing costs and to conspicuously increase assembling efficiency of the chip seal.

According to the sixth embodiment of the invention, the valve timing variation device adapted to construct the member on the rotor side of the chip seal using soft flexible resin.

According to the sixth embodiment, using soft flexible resin to construct the member on the rotor side of the chip seal enables the flexible member to be dispensed with.

According to the seventh embodiment of the present invention, the valve timing variation device is adapted so that the chip seal is pushed to the case side by the flexible member.

According to the seventh embodiment, since the chip seal is pushed to the case side by the flexible member, it is possible to prevent the movement of oil between the oil chambers which are separated by the case and the rotor.

According to the eighth embodiment, the valve timing variation device is adapted so that the chip seal is pushed to the rotor side by the flexible member.

According to the eighth embodiment, since the chip seal is pushed to the rotor side by the flexible member, it is possible to prevent the movement of oil between the oil chambers which are separated by the case and the rotor.

DETAILED DESCRIPTION OF THE PREFERRED EMBODIMENTS

The embodiments of the present invention are explained below.

Embodiment 1

Figure 1A:
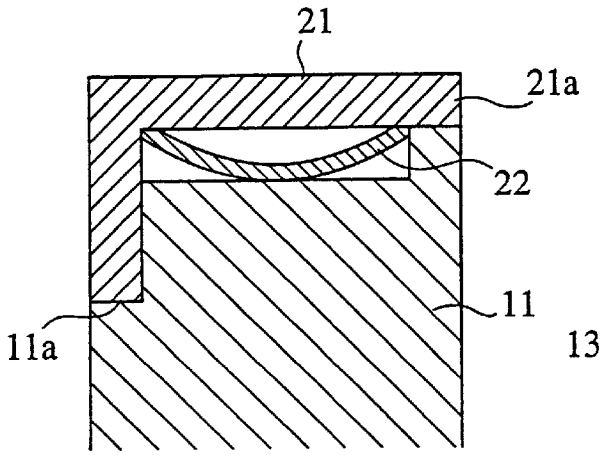
FIGS. 1A and 1B are cross sections which show the structure of a chip seal of a valve timing variation device according to the first embodiment of the present invention.
Figure 1B:
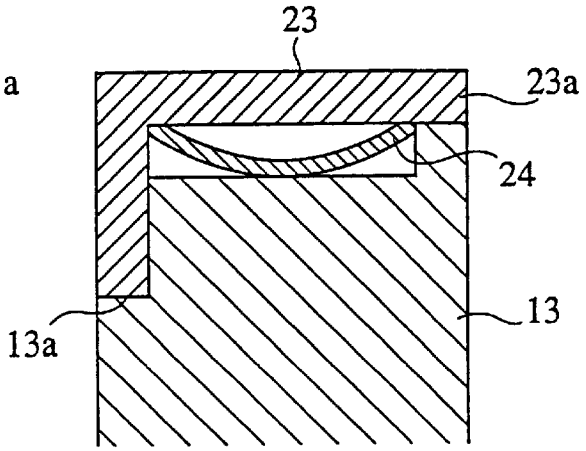

FIGS. 1A and 1B are cross sections which show the structure of a chip seal of a valve timing variation device according to the first embodiment of the present invention. In the figures, reference numeral 11 denotes a case fixed to a housing 10, 11*a* is a notch of the case 11 which stores the chip seal 21 and 13 is a rotor which fixed to the camshaft 6 and which rotates relative to the case 11. 13*a* is a notch of the rotor 13 which stores the chip seal 23. 21 and 23 are chip seals which prevent the movement of oil between the oil chambers 18 which are separated by the case 11 and the rotor 13. 21*a* and 23*a* are distal sections of the chip seals 21, 23. 22 is a metallic blade spring (flexible member) which is disposed between the case 11 and the chip seal 21 and which pressures the chip seal 21 against the rotor 13. 24 is a is a metallic blade spring (flexible member) which disposed between the rotor 13 and the chip seal 23 and which pressures the chip seal 23 against the case 11.

Next the operation of the invention will be explained.

The valve timing variable device controls the axial direction of the housing and the timing of the opening and closing of the exhaust valve and the air intake valve of an engine by controlling the amount of oil entering the oil chambers 18. In order to prevent the movement of oil between each oil chamber 18, a chip seal 21 is pressed against the rotor 13 and a chip seal 23 is pressed against the case 11.

In other words, as shown in FIG. 1A, the chip seal 21 is pressed against the rotor 13 by the metallic blade spring 22 disposed between the case 11 and the chip seal 21.

The chip seal 23 as shown in FIG. 1B is pressed against the case 11 by the metallic blade spring 22 disposed between the rotor 13 and the chip seal 23.

However the chip seals 21, 23 are different from conventional chip seals 14, 16. Their cross sectional shape is in the shape of a letter L and the sealing performance of the lateral sections of the chip seals 21, 23 is improved as the lateral sections of the chip seals 21, 23 are stored in the notches 11*a*, 13*a* of the rotor 13 and the case 11.

Figure 8:
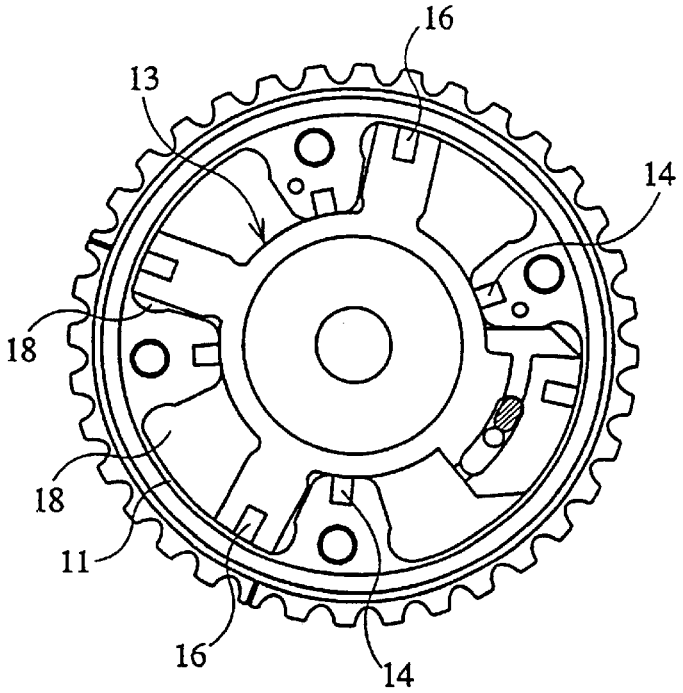
FIG.8 PRIOR ART
FIG. 8 is a cross section showing a conventional valve timing variation device.
Figure 9A:
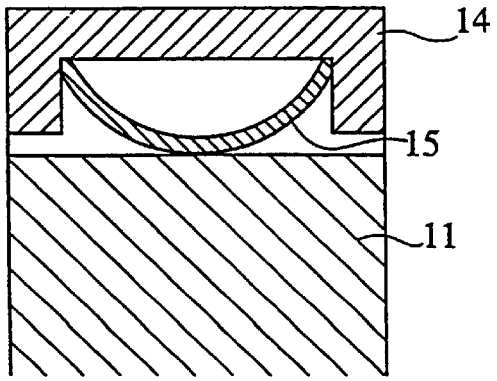
FIG.9A PRIOR ART
FIGS. 9A and 9B are cross sections which show the structure of a chip seal of a valve timing variation device.
Figure 9B:
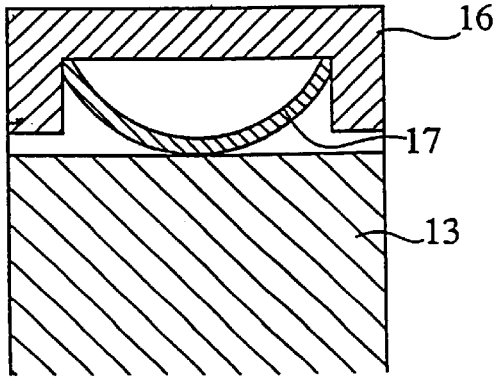
FIG.9B PRIOR ART

The assembly of the chip seal 21, 23 is performed by insertion between the case 11 and the rotor 13 from the left side of FIGS. 1A and 1B (the front of FIG. 8) towards the right side (the rear of FIG. 8) so that the chip seals 21, 23 and the metallic blade springs 22, 24 do not become disassembled. The insertion of the tip 21*a*, 23*a* of the chip seals 21, 23 is easy due to the fact that the tip 21*a*, 23*a* of the chip seals 21, 23 is narrow in comparison with conventional chip seals 14, 16. Hence the ease of assembly of the chip seal can be improved.

Embodiment 2

Figure 2A:
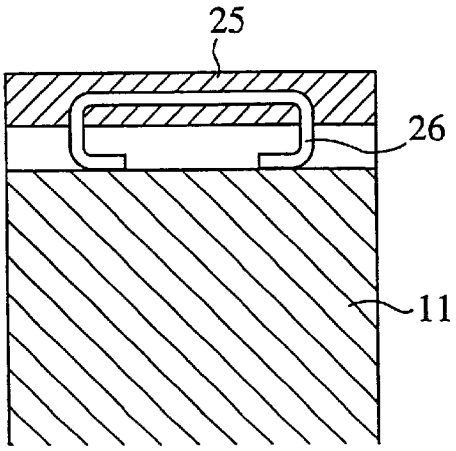
FIGS. 2A and 2B are cross sections which show the structure of a chip seal of a valve timing variation device according to the second embodiment of the present invention.
Figure 2B:
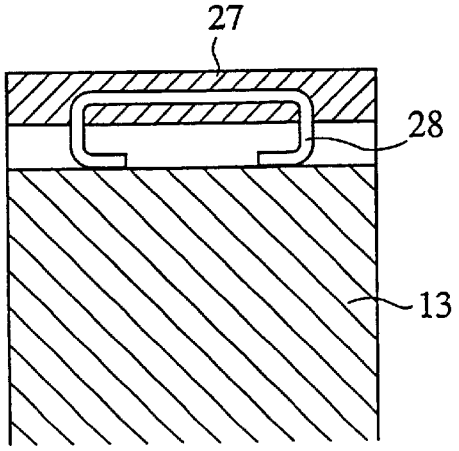

In embodiment 1 above, the L-shaped cross sectional shape of the chip seal 21, 23 was explained. However as shown in FIGS. 2A and 2B, the chip seal may be integrated with a flexible member.

In other words, the chip seal and the flexible member are integrated by the insertable form of the metallic blade spring 26, 28 with respect to the chip seal 25, 27.

In this way, when the chip seal 25, 27 is assembled, the chip seal 25, 27 and the metallic blade spring 26, 28 do not become disassembled and assembling efficiency is conspicuously improved.

Embodiment 3

Figure 3A:
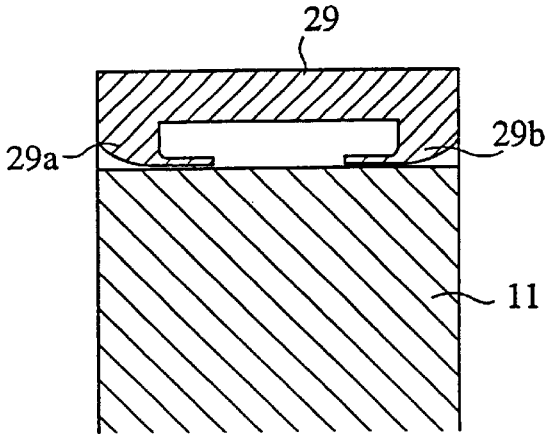
FIGS. 3A and 3B are cross sections which show the structure of a chip seal of a valve timing variation device according to the third embodiment of the present invention.
Figure 3B:
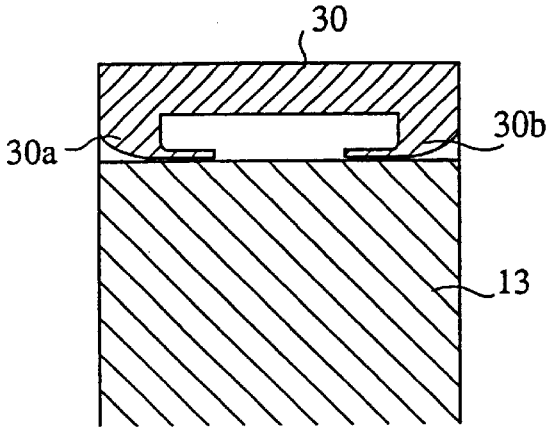

In embodiment 2 above, the chip seal was explained as integrated with the flexible member. However as shown in FIGS. 3A and 3B, both legs of the chip seal may be bent to form a flexible member.

In other words, the legs 29*a*, 29*b*, 30*a*, 30*b* of the chip seal 29, 30 have the shape as shown in FIG. 3 and the legs 29*a*, 29*b*, 30*a*, 30*b* of the chip seal 29, 30 may be flexible.

In this way, as a flexible member such as a metallic blade spring becomes redundant, costs are reduced and the assembly efficiency is conspicuously improved.

Embodiment 4

In embodiment 2 above, the chip seal was explained as integrated with the flexible member. However as shown in FIGS. 4A and 4B, a flexible member of lower hardness than the chip seal may be fixed to the chip seal.

Figure 4A:
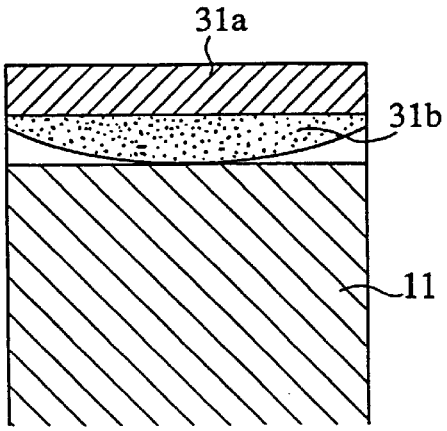
FIGS. 4A and 4B are cross sections which show the structure of a chip seal of a valve timing variation device according to the fourth embodiment of the present invention.

In other words, as shown in FIG. 4A, when the chip seal 31*a* is pushed against the rotor 13, the chip seal 31 on the rotor side 13 is constructed using a hard highly slidable resin such as nylon or carbon. The chip seal 31*b* (flexible member) on the case side 11 is constructed using a soft resin with high flexibility such as rubber or elastomer.

Figure 4B:
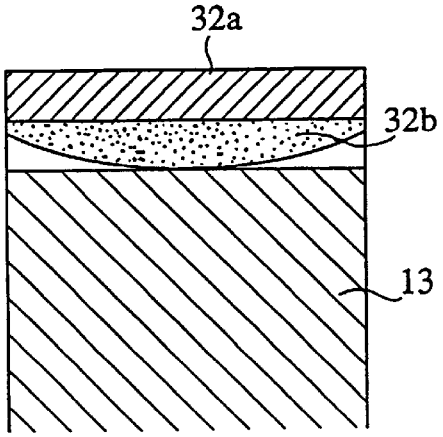

Furthermore as shown in FIG. 4B, when the chip seal 32*a* is pushed against the case 11, the chip seal 32*a* on the case side 11 is constructed using a hard highly slidable resin such as nylon or carbon. The chip seal 32*b* (flexible member) on the rotor side 13 is constructed using a soft resin with high flexibility such as rubber or elastomer.

In this way since a flexible member such as the metallic blade spring becomes redundant, costs are reduced and assembling efficiency is conspicuously improved.

Embodiment 5

Figure 5A:
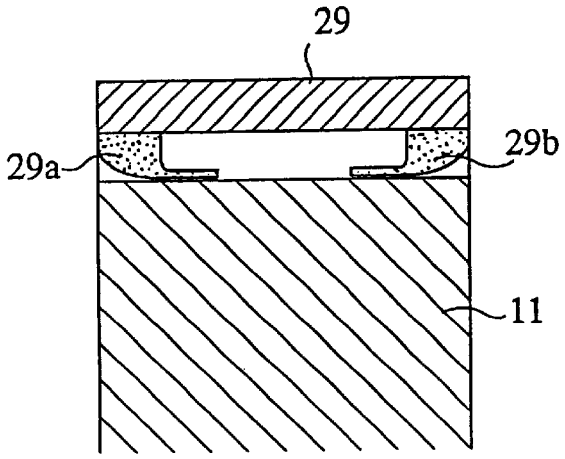
FIGS. 5A and 5B are cross sections which show the structure of a chip seal of a valve timing variation device according to the fifth embodiment of the present invention.
Figure 5B:
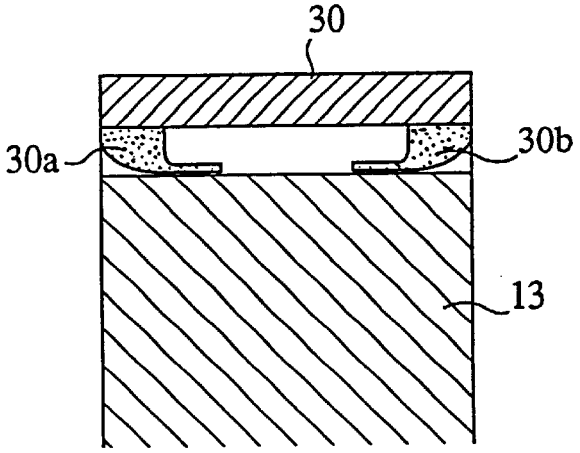

In embodiment 3 above, the flexible chip seal was explained as having flexibility in the leg sections. However as shown in FIGS. 5A and 5B, the slidable surface of the chip seals 29, 30 and the leg sections are laminated and both legs 29*a,* 29*b,* 30*a,* 30*b* may be constructed using a soft highly flexible resin such as rubber or elastomer. Hence the same effect as embodiment 3 can be achieved.

Embodiment 6

Figure 6A:
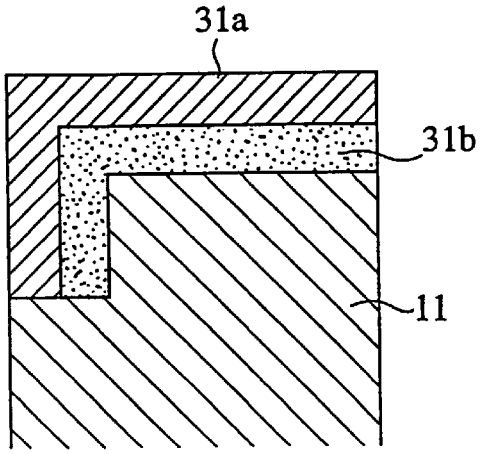
FIGS. 6A and 6B are cross sections which show the structure of a chip seal of a valve timing variation device according to the sixth embodiment of the present invention.
Figure 6B:
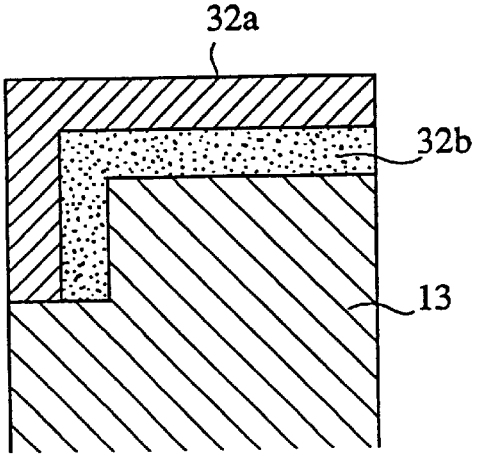
Figure 7:
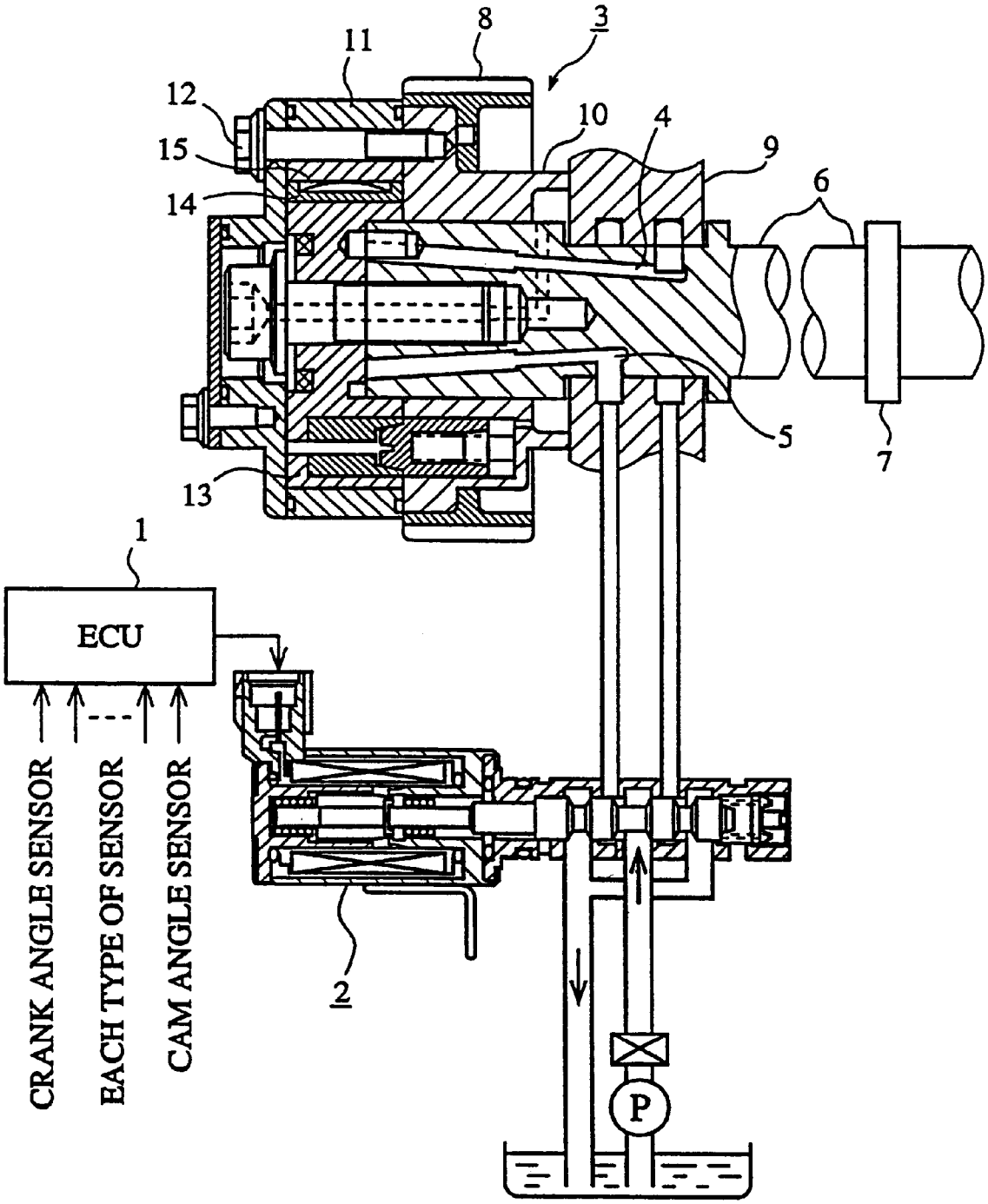
FIG.7 PRIOR ART
FIG. 7 is a cross section showing a conventional valve timing variation device.

In embodiment 4 above, a bilayer of two resins of different hardness was formed to construct the chip seal. However as shown in FIGS. 6A and 6B, the cross sectional shape of the chip seal may be in the shape of a letter L.

In this way, the same effect as embodiment 4 above is achieved and the performance of the seal on the lateral surface of the chip seal is enhanced.

What is claimed is:

1. A valve timing variation device comprising:

a case which is fixed to a housing, a rotor which is fixed to a camshaft and which rotates relative to said case, and a chip seal which prevents the movement of oil between oil chambers, which are separated by said case and said rotor, by being pushed by a flexible member wherein both legs of said chip seal are formed integrally and in one piece with said chip seal and are bent to form said flexible member.

2. A valve timing variation device according to claim 1 wherein said chip seal is being pushed on the case by said flexible member.

3. A valve timing variation device according to claim 1 wherein said chip seal is pushed on the rotor side by said flexible member.

4. A valve timing device comprising a case which is fixed to a housing, a rotor which is fixed to a camshaft and which rotates relative to said case and a chip seal which prevents the movement of oil between oil chambers, which are separated by said case and said rotor, by being pushed by a flexible member wherein said flexible member is formed integrally and in one piece with said chip seal by being formed by a bend in said chip seal.

* * * * *